US006116209A

United States Patent [19]

Christ et al.

[11] Patent Number: 6,116,209

[45] Date of Patent: Sep. 12, 2000

[54] METHOD OF UTILIZATION OF VALVE BOUNCE IN A SOLENOID VALVE CONTROLLED FUEL INJECTION SYSTEM

[75] Inventors: Wilhelm W. Christ, Wyoming; Mike Smith, Grand Haven; Donna Mosher, Kentwood; Michael VanAllsburg, Grand Rapids, all of Mich.; Werner Pape, Stuttgart, Germany

[73] Assignee: Diesel Technology Company, Wyoming, Mich.

[21] Appl. No.: 09/085,745

[22] Filed: May 27, 1998

[51] Int. Cl.[7] ..... F02B 3/10

[52] U.S. Cl. ..... 123/299; 123/506

[58] Field of Search ..... 123/299, 490, 123/459, 506, 458; 361/154

[56] References Cited

U.S. PATENT DOCUMENTS

| | | | |
|---|---|---|---|
| Re. 34,999 | 7/1995 | Kelly . | |
| 4,577,606 | 3/1986 | Bohringer et al. | 123/506 |
| 4,653,723 | 3/1987 | Rizk et al. | 123/458 |
| 4,704,999 | 11/1987 | Hashikawa et al. . | |
| 4,720,763 | 1/1988 | Bauer | 361/154 |
| 4,785,787 | 11/1988 | Riszk et al. | 123/506 |
| 4,788,960 | 12/1988 | Oshizawa | 123/458 |
| 4,832,312 | 5/1989 | Linder et al. | 123/458 |
| 4,838,232 | 6/1989 | Wich | 123/458 |
| 5,005,548 | 4/1991 | Rembold et al. . | |
| 5,070,836 | 12/1991 | Wahl et al. . | |
| 5,072,706 | 12/1991 | Eblen et al. . | |
| 5,103,785 | 4/1992 | Henkel . | |
| 5,168,847 | 12/1992 | Grieshaber et al. . | |
| 5,402,760 | 4/1995 | Takeuchi et al. | 123/300 |
| 5,406,440 | 4/1995 | Wieloch | 361/154 |
| 5,477,834 | 12/1995 | Yoshizu . | |
| 5,605,134 | 2/1997 | Martin . | |
| 5,650,909 | 7/1997 | Remele et al. | 361/154 |
| 5,673,165 | 9/1997 | Kuhn et al. | 361/154 |

*Primary Examiner*—Erick R. Solis
*Attorney, Agent, or Firm*—Brooks & Kushman P.C.

[57] ABSTRACT

A method of utilizing the first valve bounce is used in a diesel engine having a solenoid valve controlled fuel injection system, wherein the solenoid-actuated valve is movable between a fully closed position for injection and a fully open position preventing injection. The method includes: (1) energizing the solenoid for valve movement to the fully closed position for commencing pilot injection; (2) de-energizing the solenoid immediately prior to the valve reaching the fully closed position for pilot injection in order to facilitate movement of the valve toward the fully open position immediately after the valve has reached the fully closed position, thereby preventing subsequent valve bounces; and (3) re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

11 Claims, 3 Drawing Sheets

METHOD OF UTILIZATION OF VALVE BOUNCE IN A SOLENOID VALVE CONTROLLED FUEL INJECTION SYSTEM

TECHNICAL FIELD

The present invention relates to pilot injection used in a diesel engine, and more particularly, to a method of preventing valve bounce in a diesel engine having a solenoid valve controlled fuel injection system.

BACKGROUND OF THE INVENTION

Diesel engines often employ a fuel precharge or pilot injection prior to main injection in order to reduce nitrous oxide emissions and improve fuel economy. The pilot injection is used to warm the engine cylinder and to reduce ignition delay prior to burning of the main fuel charge. In effect, the pilot injection charge helps the main injection charge burn more efficiently.

Pilot injection is typically accomplished in a diesel engine by a solenoid-actuated fuel injector. A typical solenoid-actuated fuel injector valve is illustrated in FIGS. 3 and 4. As shown, the fuel injector 10 includes a body 12 with a stepped bore 14 formed therethrough. A valve stop 16 is disposed within the stepped bore 14 and forms a chamber 18 around the head portion 20 thereof. The chamber 18 is in continuous fluid communication with the channel 22, and is in selective fluid communication with the channel 24. The control valve 26 is operative to selectively communicate and discommunicate the channel 24 from the chamber 18 by engaging or disengaging the valve seat 28.

The valve 26 is solenoid-actuated for movement between the closed position shown in FIG. 3 in which the valve surface 30 engages the seat 28, and the open position shown in FIG. 4 in which the lower surface 32 of the valve 26 engages the top surface 34 of the valve stop 16. With the valve 26 in the closed position, as shown in FIG. 3, pressurization of fuel in the flow channel 24 will cause the fuel injector to inject fuel into an engine cylinder because it is blocked from flowing into the chamber 18. However, with the valve 26 in the open position, as shown in FIG. 4, fuel may flow from the channel 24 through the chamber 18, and further through channel 22 for low pressure fuel flow between injection cycles, thereby preventing injection.

Referring to FIG. 1, a typical prior art control valve position versus cam angle graph is shown in which pilot and main injection charges are injected. For pilot injection, the control valve closes, as shown in FIG. 3, and the valve surface 30 engages against the seat 28. Due to the limited amount of force applied to the valve by the solenoid and the elastic forces involved when the valve surface 30 engages the seat 28, the valve 26 tends to bounce, as illustrated between times $t_a$ and $t_b$ in FIG. 1. Accordingly, the pilot injection charge is adversely affected. At time $t_b$, the solenoid is de-energized so that the valve may open, and a spring (not shown) is operative to move the valve from its closed position to its normally open position shown in FIG. 4. However, when the valve reaches its open position at time $t_c$, the lower surface 32 of the valve 26 will typically bounce against the top surface 34 of the valve stop 16 as a result of the limited force applied by the spring, and the elasticity of the contact between the valve 26 and the valve stop 16. Accordingly, as shown in FIG. 1, between times $t_c$ and $t_d$, the valve 26 will typically rebound against the top surface 34 of the valve stop 16 numerous times. Once the bounce or rebound has stabilized, the control valve 26 will be re-closed between times t*d* and t*e*, as shown in FIG. 1, for main injection.

The valve bounce between times t*a* and t*b*, and between times t*c* and t*d*, creates an undesirable delay between pilot injection and main injection. For example, between times t*c* and t*d*, the valve must be stabilized prior to initiating re-closing for main injection, and this delay creates a large gap between pilot and main injection, which decreases the effectiveness of the pilot injection charge. This time delay can involve an 11 degree cam rotation, as illustrated in FIG. 1. Accordingly, waiting for a stable position of the valve at its closure and waiting until the rebound dies out before starting the second valve movement makes both pilot output and separation between pilot and main injection unacceptably long.

It is desirable to provide a method of reducing or eliminating valve bounce in a fuel injection system in a manner which enables reduction of separation between pilot and main injection for more efficient fuel burning.

DISCLOSURE OF THE INVENTION

The present invention overcomes the above-referenced shortcomings of prior art injection methods by re-energizing the solenoid immediately prior to the valve reaching the fully open position after pilot injection, whereby to facilitate movement of the valve toward the fully closed position for main injection immediately after the valve reaches the fully open position, thus preventing subsequent valve bounces and decreasing time lag between pilot and main injection.

More specifically, the present invention provides a method of preventing valve bounce in a diesel engine having a solenoid valve controlled fuel injection system, wherein the solenoid-actuated valve is movable between a fully closed position for injection and a fully open position preventing injection. The method includes: 1) energizing the solenoid for valve movement to the fully closed position for commencing pilot injection; 2) de-energizing the solenoid for valve movement toward the fully open position for discontinuing pilot injection; and 3) re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

Alternatively, the present invention provides a method of preventing valve bounce including: 1) energizing the solenoid for valve movement toward the fully closed position for commencing pilot injection; 2) de-energizing the solenoid immediately prior to the valve reaching the fully closed position for pilot injection in order to facilitate movement of the valve toward the fully open position immediately after the valve has reached the fully closed position, thereby preventing subsequent valve bounces; and 3) re-energizing the solenoid to facilitate return movement of the valve toward the fully closed position for main injection after pilot injection.

In a further alternative embodiment, the method comprises both de-energizing the solenoid immediately prior to the valve reaching the fully closed position for pilot injection, and re-energizing the solenoid immediately prior to the valve reaching the fully open position.

Accordingly, an object of the present invention is to provide a method of reducing valve bounce in a solenoid-actuated fuel injection control valve.

Another object of the present invention is to provide a method of reducing separation between pilot and main injection in a solenoid-actuated fuel injection control valve.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
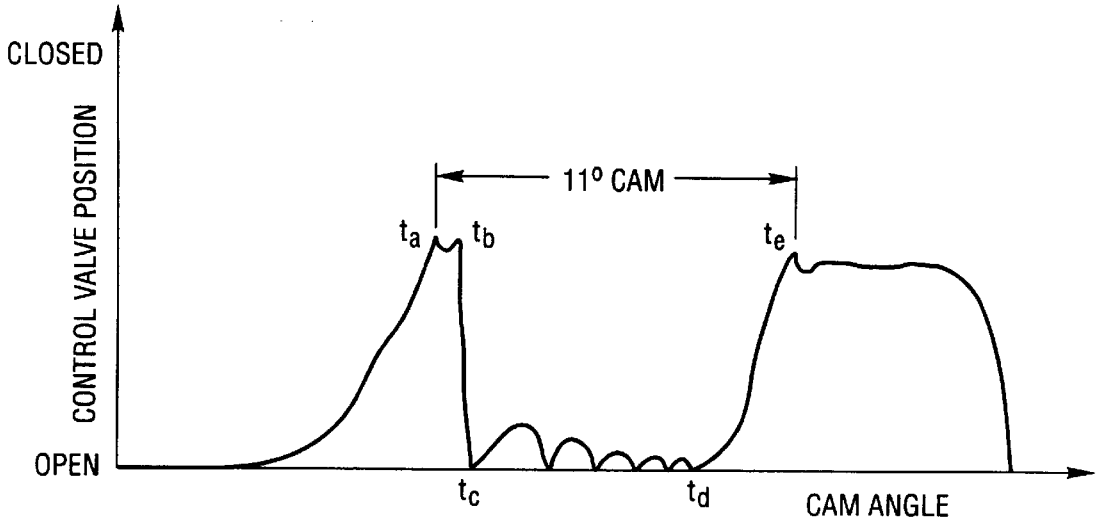
Fig. 1 (PRIOR ART)
FIG. 1 shows a graphical illustration of control valve position versus cam angle in accordance with a prior art fuel injection method.
Figure 2:
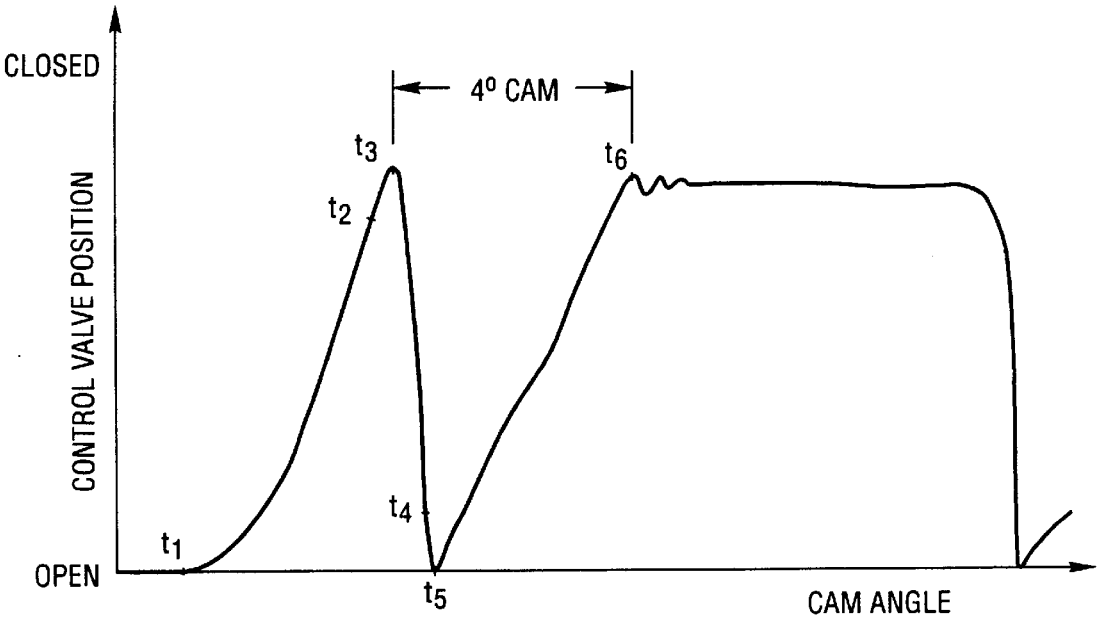
FIG. 2 shows a graphical illustration of control valve position versus cam angle in accordance with the present invention.
Figure 3:
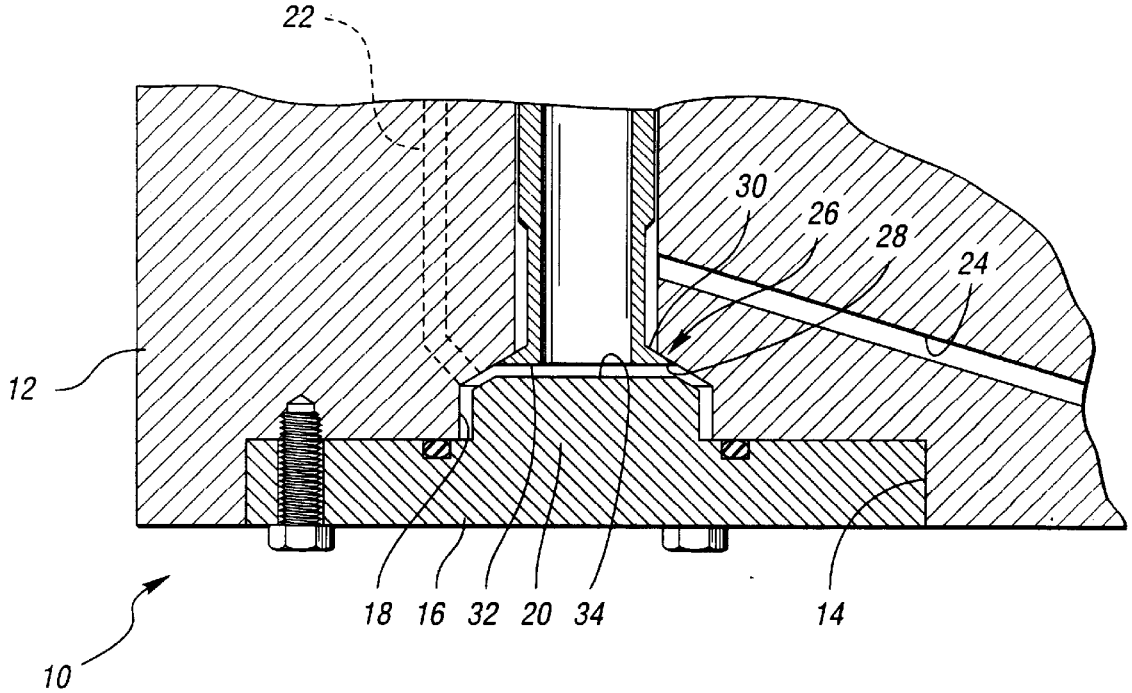
FIG. 3 shows a cut-away cross-sectional view of a typical control valve, with the valve in the closed position.
Figure 4:
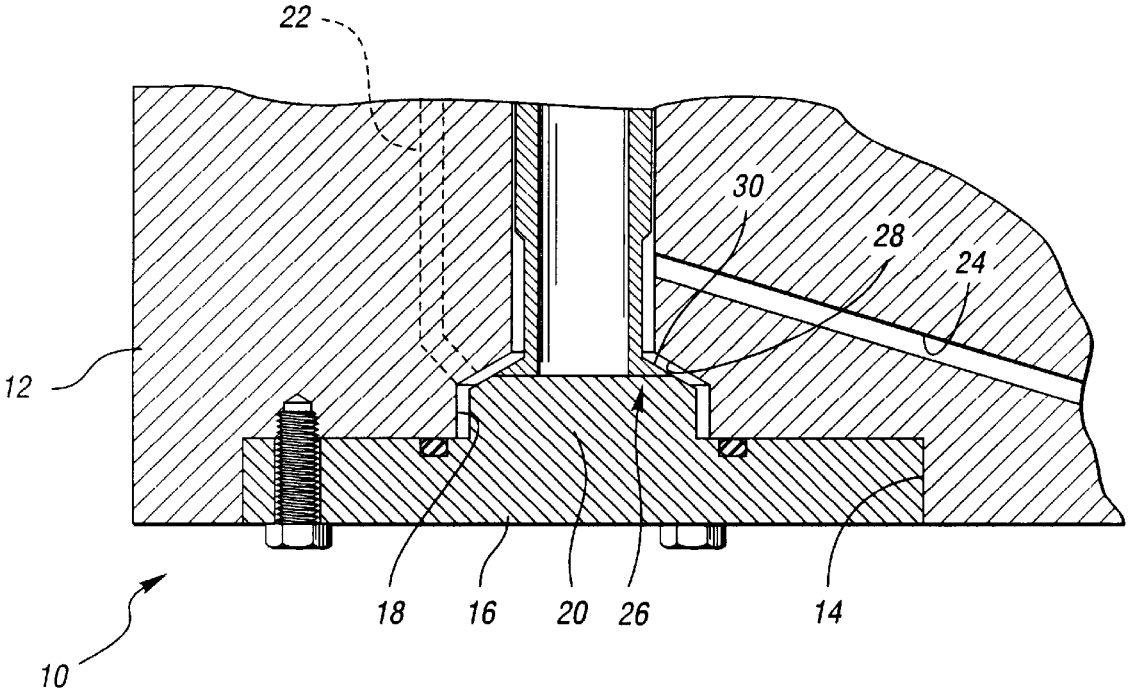
FIG. 4 shows the control valve as illustrated in FIG. 3, with the valve in the open position.

The present invention is herein described with reference to FIGS. 2 through 5. Referring to FIG. 2, a control valve position versus cam angle graph is illustrated in accordance with the present invention. At time $t_1$ or earlier, depending on the delay time of the valve and the time required to build up the magnetic field, the control valve solenoid is energized for moving the control valve from the open position to the closed position for pilot injection. Referring to FIG. 4, as the valve surface 30 approaches the valve seat 28, at time $t_2$, shown in FIG. 2, the solenoid is de-energized immediately prior to engagement of the control valve surface 30 with the seat 28 (preferably approximately 2–4 microseconds prior to engagement). De-energization of the solenoid is not instantaneous, therefore the control valve 26 continues to move to the point at which it engages the seat 28. At this point, illustrated as $t_3$ in FIG. 2, the solenoid is almost completely de-energized, and therefore the control valve surface 30 does not bounce against the seat 28, but rather immediately moves toward the fully open position at time $t_3$. As stated above, the de-energization of the solenoid preferably occurs at 2–4 microseconds prior to engagement of the control valve with the seat 28, however, this time will vary depending upon the application, but will typically be less than 5 microseconds prior to the valve reaching the valve seat.

Referring to FIG. 2, between times $t_3$ and $t_4$, the valve is returning toward the fully open position by means of the spring (not shown). In order to prevent valve bounce when the lower surface 32 of the valve 26 engages the top surface 34 of the closure cap 16, as shown in FIG. 3, the solenoid is re-energized at time $t_4$, shown in FIG. 2. Again, time $t_4$ is preferably between 2–4 microseconds prior to engagement of the lower surface 32 of the valve with the top surface 34 of the valve stop 16, but will typically be less than 5 microseconds, depending upon the application. Because the solenoid does not fully energize instantaneously, the spring continues to move the valve to the fully open position, and when the valve 26 bounces off the top surface 34 of the valve stop 16, the elasticity of this bounce is used advantageously for commencing re-closing of the valve immediately. At time $t_5$ shown in FIG. 2, the solenoid is at least partially energized, which prevents bouncing of the valve against the closure cap at this point and allows use of the elastic bounce to assist in immediate re-closing of the control valve. Accordingly, between $t_5$ and $t_6$, the control valve moves immediately in the direction of the closed position to commence main injection without first requiring a waiting period for the bouncing to die out. This may result in a substantially reduced separation between pilot injection and main injection, which is illustrated as a four degree cam angle rotation in FIG. 2. In this manner, the effectiveness of pilot injection is fully utilized, and the method provided takes advantage of the closing rebound at pilot injection and opening rebound prior to main injection for decreasing separation between pilot and main injection.

In other words, pull-in current of closing movement for pilot injection is shut off early enough so that the opening movement can happen without magnetic counter force. Also, pull-in current of main injection is risen in a way such that the magnetic force increases exactly in the same time as the control valve is projected toward its closed position by the opening rebound, thus supporting the closing movement initiated by the opening rebound.

Figure 5:
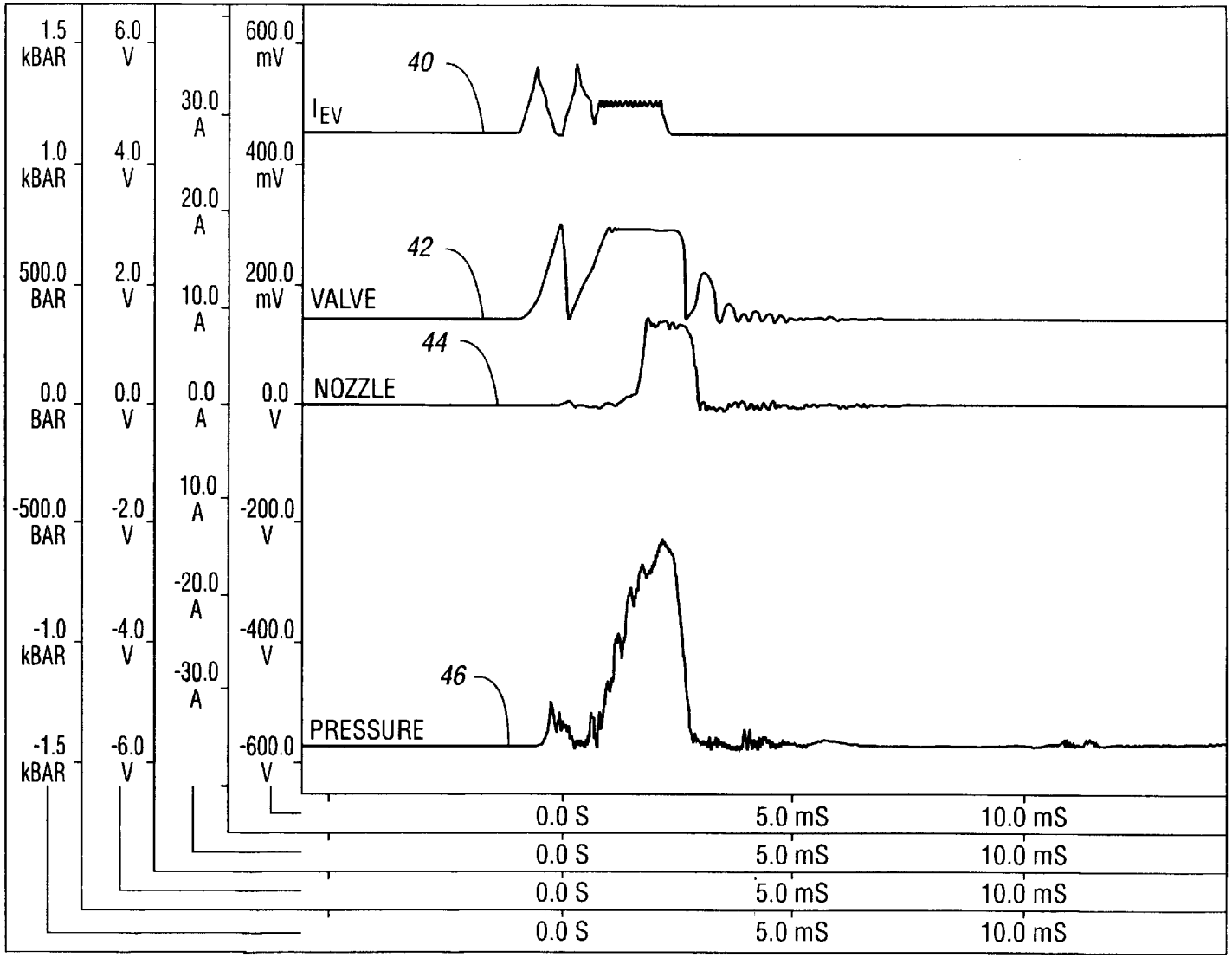
FIG. 5 shows a strip chart recording illustrating solenoid current versus time, control valve position versus time, needle valve position versus time, and fuel pressure versus time during an injection cycle in accordance with the present invention.

Turning to FIG. 5, a real-time strip chart recording is shown illustrating solenoid current versus time (40), control valve position versus time (42), needle valve position versus time (44), and fuel pressure in the injector versus time (46). As shown, by manipulation of the solenoid current $I_{ev}$, valve bounce is completely eliminated at valve closing for pilot injection and at opening rebound for main injection.

Accordingly, the present invention provides a method of preventing subsequent valve bounces in a diesel engine having a solenoid valve controlled fuel injection system, wherein the solenoid-actuated valve is movable between a fully closed position for injection and a fully open position preventing injection. The method includes: (1) energizing the solenoid for valve movement to the fully closed position for commencing pilot injection; (2) de-energizing the solenoid immediately prior to the valve reaching the fully closed position for pilot injection in order to facilitate movement of the valve toward the fully open position immediately after the valve has reached the fully closed position, thereby preventing subsequent valve bounces; and (3) re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

While the best mode for carrying out the invention has been described in detail, those familiar with the art to which this invention relates will recognize various alternative designs and embodiments for practicing the invention within the scope of the appended claims.

What is claimed is:

1. A method of preventing valve bounce in a diesel engine having a solenoid valve controlled fuel injection system, wherein the solenoid-actuated valve is movable between a fully closed position for injection and a fully open position preventing injection, the method comprising:

energizing the solenoid for valve movement to the fully closed position for commencing pilot injection;

de-energizing the solenoid for valve movement toward the fully open position for discontinuing pilot injection; and re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

2. The method of claim 1, wherein said step of re-energizing the solenoid immediately prior to the valve reaching the fully open position comprises re-energizing the solenoid less than 5 microseconds prior to the valve reaching the fully open position.

3. The method of claim 1, wherein said step of de-energizing the solenoid for valve movement toward the fully open position comprises de-energizing the solenoid immediately prior to the valve reaching the fully closed position to facilitate movement of the valve toward the fully open position immediately after the valve reaches the fully closed position for pilot injection, thus preventing subsequent valve bounces.

4. The method of claim 3, wherein said step of de-energizing the solenoid immediately prior to the valve reaching the fully closed position comprises de-energizing the solenoid less than 5 microseconds prior to the valve reaching the fully closed position.

5. A method of preventing valve bounce in a diesel engine having a solenoid valve controlled fuel injection system, wherein the solenoid-actuated valve is movable between a fully closed position for injection and a fully open position preventing injection, the method comprising:

energizing the solenoid for valve movement to the fully closed position for commencing pilot injection;

de-energizing the solenoid immediately prior to the valve reaching the fully closed position for pilot injection in order to facilitate movement of the valve toward the fully open position immediately after the valve has reached the fully closed position, thereby preventing subsequent valve bounces; and re-energizing the solenoid to facilitate return movement of the valve toward the fully closed position for main injection after pilot injection.

6. The method of claim 5, wherein said step of de-energizing the solenoid immediately prior to the valve reaching the fully closed position comprises de-energizing the solenoid less than 5 microseconds prior to the valve reaching the fully closed position.

7. The method of claim 5, wherein said step of re-energizing the solenoid to facilitate return movement of the valve toward the fully closed position for main injection comprises re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

8. The method of claim 7, wherein said step of re-energizing the solenoid immediately prior to the valve reaching the fully open position comprises re-energizing the solenoid less than 5 microseconds prior to the valve reaching the fully open position.

9. A method of preventing valve bounce in a diesel engine having a solenoid valve controlled fuel injection system, wherein the solenoid-actuated valve is movable between a fully closed position for injection and a fully open position preventing injection, the method comprising:

energizing the solenoid for valve movement toward the fully closed position for commencing pilot injection;

de-energizing the solenoid immediately prior to the valve reaching the fully closed position for pilot injection in order to facilitate movement of the valve toward the fully open position immediately after the valve has reached the fully closed position, thereby preventing subsequent valve bounces; and re-energizing the solenoid immediately prior to the valve reaching the fully open position, whereby to facilitate movement of the valve toward the fully closed position for main injection immediately after the valve reaches the fully open position, thus preventing subsequent valve bounces and decreasing time lag between pilot and main injection.

10. The method of claim 9, wherein said step of de-energizing the solenoid immediately prior to the valve reaching the fully closed position comprises de-energizing the solenoid less than 5 microseconds prior to the valve reaching the fully closed position.

11. The method of claim 9, wherein said step of re-energizing the solenoid immediately prior to the valve reaching the fully open position comprises re-energizing the solenoid less than 5 microseconds prior to the valve reaching the fully open position.

* * * * *